US006642640B1

(12) United States Patent
Helbig et al.

(10) Patent No.: US 6,642,640 B1
(45) Date of Patent: Nov. 4, 2003

(54) DISCHARGE LAMP

(75) Inventors: Peter Helbig, Sontheim (DE); Uwe Kantim, Heidenheim (DE); Gerwin Thiel, Eichenau (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 86 days.

(21) Appl. No.: 09/857,623

(22) PCT Filed: Oct. 6, 2000

(86) PCT No.: PCT/DE00/03518

§ 371 (c)(1),
(2), (4) Date: Jun. 7, 2001

(87) PCT Pub. No.: WO01/31670

PCT Pub. Date: May 3, 2001

(30) Foreign Application Priority Data

Oct. 28, 1999 (DE) ..... 199 51 873

(51) Int. Cl.[7] ..... H01J 5/48; H01J 5/50
(52) U.S. Cl. ..... 313/318.01; 439/699.1
(58) Field of Search ..... 313/318.01, 25, 313/635, 493, 480, 39, 483, 491; 439/236, 76, 646, 83, 619, 617, 699.1, 699.2

(56) References Cited

U.S. PATENT DOCUMENTS 4,358,701 A * 11/1982 Roche et al. ..... 315/47
4,575,656 A * 3/1986 Anderson et al. ..... 313/492
4,644,220 A * 2/1987 Carley ..... 313/318.01
4,688,874 A * 8/1987 Bjorkman ..... 439/56
4,786,841 A * 11/1988 Fohl et al. ..... 313/493
5,008,588 A 4/1991 Nakahara
5,216,318 A * 6/1993 Van Dulmen et al. ..... 313/49
5,239,226 A * 8/1993 Seredich et al. ..... 313/318.01
5,270,610 A * 12/1993 Schoenherr et al. ... 313/318.01
5,320,548 A * 6/1994 Schadhauser ..... 439/236
5,539,277 A * 7/1996 Jansma ..... 313/489
5,602,444 A * 2/1997 Jansma ..... 313/489
5,757,132 A * 5/1998 Matsuno et al. ..... 313/607
5,818,500 A * 10/1998 Edwards et al. ..... 347/238
5,932,960 A * 8/1999 Terada et al. ..... 313/485
6,008,570 A * 12/1999 Helbig et al. ..... 313/318.01
6,014,118 A * 1/2000 Edwards et al. ..... 345/75.2

FOREIGN PATENT DOCUMENTS

FR 2 050 692 4/1971
WO 98 49712 11/1998

* cited by examiner

*Primary Examiner*—Sandra O'Shea
*Assistant Examiner*—Dalei Dong
(74) *Attorney, Agent, or Firm*—Carlo S. Bessone

(57) ABSTRACT

To ensure reliable electric contact, a discharge lamp has a tubular lamp vessel (1), a lamp base (4) and lamp electrodes (2, 3) which are applied to the wall of the lamp vessel (1) and in each case have an electrode section (20, 30) which is arranged outside the interior (11) of the lamp vessel (1) and serves as supply lead. The electric base contacts (5, 6) are connected in each case to an electrically conductive spring element (8, 9), each spring element (8, 9) bearing against the wall of the at least one tubular lamp vessel (1) and making an electric contact between in each case one electrode section (20, 30), arranged outside the lamp vessel (1), and a base contact (5, 6).

9 Claims, 1 Drawing Sheet

DISCHARGE LAMP

Figure 1:
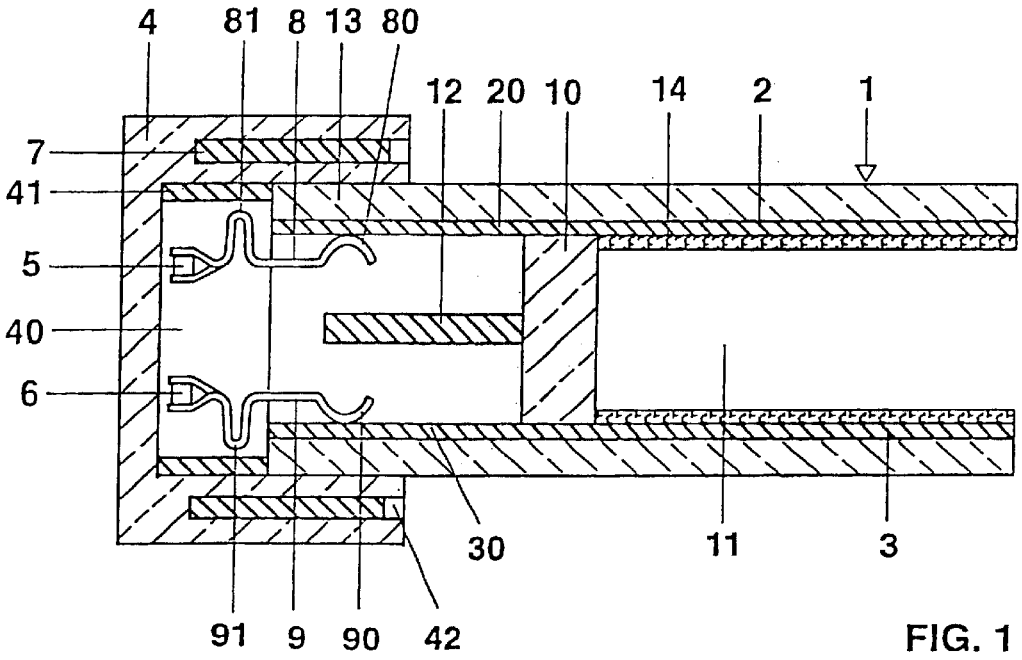

The invention relates to a discharged lamp, and more particularly, to a discharge lamp wherein its base contacts are connected in each case to an electrically conductive spring element. Each spring element bears against the wall of the at least one tubular lamp vessel and making an electric contact between in each case one section, arranged outside the lamp vessel, of a lamp electrode and a base contact. The spring elements ensure reliable electric contact between the base contacts and the electrode sections arranged outside the lamp vessel, and simple provision of a base for the discharge lamp.

PRIOR ART

Such a discharge lamp is disclosed, for example, in German patent DE 197 18 395 C1. This patent describes a fluorescent lamp with a tubular discharge vessel and an enclosed inert gas. This lamp has elongated electrodes which run parallel to the longitudinal axis of the lamp and serve to produce a gas discharge. At least one of these electrodes has a section with is lead out of the interior of the discharge vessel, is developed as a supply lead and is fitted on the inner wall of the tubular discharge vessel. The lamp base is equipped with two contact pins which in each case are connected in an electrically conducting fashion to one of the lamp electrodes.

SUMMARY OF THE INVENTION

It is the object of the invention to provide a base for a discharge lamp of the generic type which ensures reliable electric contact is made between the electrodes and the base contacts.

This object is achieved according to the invention by means of the characterizing features of patent claim 1. Particularly advantageous designs of the invention are described in the subclaims.

The discharge lamp according to the invention is distinguished from a discharge lamp of the generic type in that its base contacts are connected in each case to an electrically conductive spring element, each spring element bearing against the wall of the at least one tubular lamp vessel and making an electric contact between in each case one section, arranged outside the lamp vessel, of a lamp electrode and a base contact. The spring elements ensure reliable electric contact between the base contacts and the electrode sections arranged outside the lamp vessel, and simple provision of a base for the discharge lamp.

The spring elements are advantageously constructed as leaf springs with cambered ends, the cambered leaf spring ends in each case making electric contact with one of the aforementioned electrode sections. The cambers ensure a sufficiently large contact surface between the leaf springs and the electrode sections, and prevent damage to the surface of the electrode sections. Moreover, the leaf springs are advantageously provided in each case with at least one expansion loop by means of which account is taken of the different coefficients of thermal expansion of the lamp vessel and the leaf springs. In order to ensure a particularly reliable electric and mechanical contact is made, the spring elements are advantageously connected in each case to the corresponding electrode section by means of a soldered joint. By contrast with a welded joint, the soldered joint has the advantage that, given a base shell plugged on the lamp vessel, it can be produced by inducing heating of the base contacts by radio frequency, when the electrode sections, arranged outside the at least one lamp vessel, or the spring elements have had soldering paste applied or have been tinned.

The electrode sections constructed as supply leads are advantageously fitted on the inner wall of the at least one tubular lamp vessel, and the spring elements therefore bear against the inner wall of the lamp vessel and make mechanical and electric contact with these electrode sections. As a result, the electrode sections and also the spring elements can be better protected against damage and being touched.

In accordance with a preferred exemplary embodiment of the invention, a first end of the at least one lamp vessel is equipped with a base shell which is provided as a component of the lamp base with the at least two base contacts, the base contacts being connected in each case to an electrode section lead out of the first end of the at least one lamp vessel. Consequently, in the case of the preferred exemplary embodiment the electrodes are supplied with power exclusively via the first end of the at least one lamp vessel. It is therefore sufficient in this case to provide the discharge lamp with a base at only one end, or else to provide the other end of the at least one lamp vessel with a base shell without electric contacts which serves only to hold the lamp in a lampholder. However, it is also possible to provide both ends of the at least one lamp vessel with base shells which have electric contacts. In this case, there is lead out of both ends of the at least one lamp vessel at least one electrode section which is constructed as a supply lead, bears against the inner wall of the at least one tubular lamp vessel and is connected to a base contact.

The base shell or the base shells of the lamp base advantageously consist of an electrically insulating, thermoplastic material. This permits the base shell or the base shells to be fused to the ends of the at least one lamp vessel. The lamp base advantageously has at least one base shell with a cup-like receptacle for an end of the at least one lamp base, whose diameter is coordinated with the outside diameter of the corresponding end, and in which the spring elements are arranged. The cup-like receptacle firstly offers the spring elements adequate protection against damage and being touched, and secondly permits the spring elements to be positioned accurately relatively to the corresponding end of the at least one lamp vessel and to the electrode sections fitted on the inner wall and constructed as supply leads. Each base shell advantageously has a means capable of being heated by radio-frequency induction and is arranged in each case in an annular groove surrounding the receptacle of the corresponding base shell. These means can be heated by radio-frequency induced voltage pulses such that the thermoplastic material of the base shell fuses in the region of the groove and, after hardening, forms a fused connection with the at least one lamp vessel. An electrically insulating means can be arranged with advantage between the spring elements arranged in the same receptacle.

DESCRIPTION OF THE PREFERRED EXEMPLARY EMBODIMENT

Figure 2:
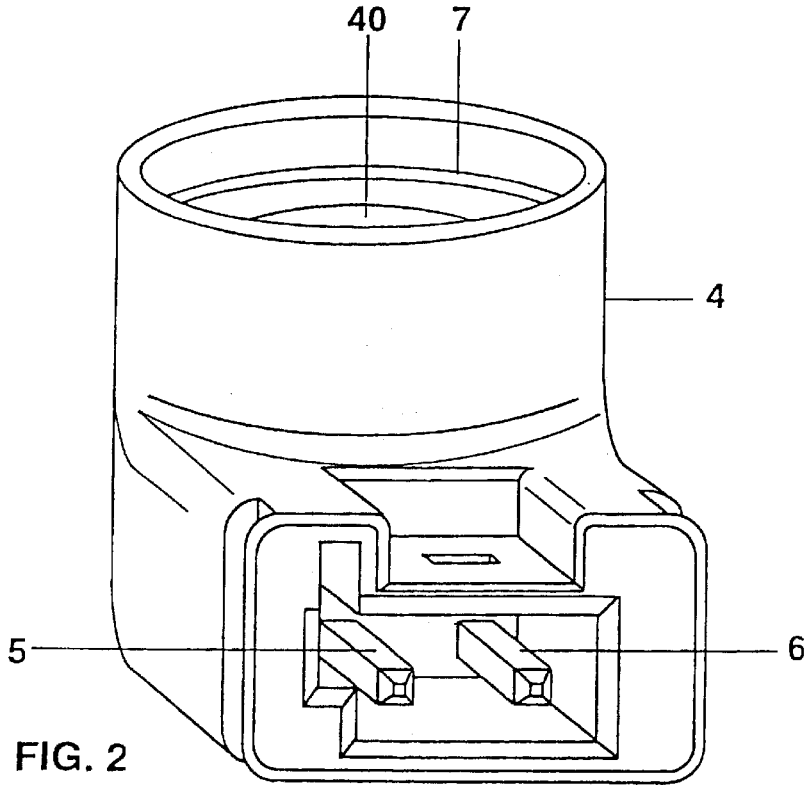

The invention is explained in more detail below with the aid of a preferred exemplary embodiment. In the drawing:

FIG. 1 shows a cross section through an end, provided with a base, of the discharge vessel of a discharge lamp in accordance with the preferred exemplary embodiment, and FIG. 2 shows a plan view of the base shell, equipped with the base contacts, of a discharge lamp in accordance with the preferred exemplary embodiment.

The discharge lamp according to the preferred embodiment is a gas discharge lamp which has an inert gas or an inert gas mixture as discharge medium. The discharge lamp has a linear, tubular discharge vessel 1 which is made from glass and sealed a gastight fashion. One end 13 of the discharge vessel 1 is sealed in a gastight fashion by means of a stopper 10 and glass solder, while the other end (not illustrated) has been fused off. The discharge medium is enclosed in the interior 11 of the discharge vessel 1. The sealing stopper 10 has an exhaust tube 12 via which the discharge medium was filled into the interior 11 of the discharge vessel 1, and which was subsequently fused off in a gastight fashion. Two strip-shaped electrodes 2, 3 resembling conductor tracks and situated opposite one another are applied to the inner wall of the tubular discharge vessel 1 which serve to produce a gas discharge in the interior 11 of the discharge vessel 1. The electrodes 2, 3 are coated in the interior 11 of the discharge vessel 1 with a dielectric 14, for example with a thin glass layer and/or a fluorescent layer. For this reason, during operation a dielectrically impeded discharge forms between the electrodes 2, 3 in the discharge lamp. The electrodes 2, 3 in each case have a section 20, 30 which is lead through the closure 10, projects from the interior 11 of the discharge vessel 1 and bears outside the discharge space 11, in the region of a discharge vessel end 13, against the inner wall of the discharge vessel 1. These electrode sections 20, 30 serve as supply leads for the sections, arranged inside the discharge space 11, of the electrodes 2, 3. The two ends 13 of the tubular discharge vessel 1 are provided with a base shell 4 consisting of an electrically insulating, thermoplastic polymer and together form the lamp base. Only one of the two base shells 4 is equipped with electric base contacts 5, 6, which are constructed as contact pins. Both base shells 4 have a cup-like receptacle 40 for in each case one end 13 of the discharge vessel 1. The diameter of the receptacle 40 of each base shell is coordinated to fit with the outside diameter of the respective end 13 of the discharge vessel 1. Moreover, both base shells 4 are provided with depth stops 41 which determine the depth to which the discharge vessel ends 13 dip into the receptacle 40. Furthermore, both base shells 4 have a preferably ferromagnetic metal ring 7 which is arranged in a groove 42 surrounding the receptacle 40 in angular fashion. These metal rings 7 serve to produce a permanent fused connection between the thermoplastic material of the base shells 4 and the outer wall of the discharge vessel ends 13 by means of radio-frequency induced voltage pulses. Arranged in the receptacle 40 of one of the two base shells 4 are two metal leaf springs 8, 9, which produce an electric connection between in each case a contact pin 5 or 6 and an electrode section 20 or 30. The two leaf springs 8, 9 in each case have a cambered end 80, 90 which bears resiliently against one of the electrode sections 20 or 30 and is soldered thereto. The other end of the leaf spring is clipped in each case onto a base pin 5, 6 and soldered or welded to the latter. Both leaf springs 8, 9 also have an expansion loop 81, 91 which is formed by a section of the springs 8, 9 which is bent in an approximately U-shaped fashion.

The invention is not limited to the exemplary embodiment explained in more detail above. For example, the discharge lamp can also have more than only two electrodes, and each of the base shells can be equipped with electric contacts such that the electrode sections serving as supply leads can be lead out of both ends of the discharge vessel. Moreover, the invention can also be applied to discharge lamps which have electrodes fitted on the outer wall of the at least one tubular lamp vessel. In this case, the spring elements bear against the outer wall of the lamp vessel. It is also possible, furthermore, to provide only one end of the lamp vessel with a base shell. The other end of the lamp vessel can be fastened, for example, on a heat sink.

What is claimed is:

1. A discharge lamp having the following features:

at least one tubular lamp vessel (1) with sealed ends (13), a discharge medium which is arranged in the interior (11) of the at least one lamp vessel (1), at least two electrodes (2, 3) for exciting the discharge medium, the electrodes (2, 3) in each case having a section (20, 30) which is arranged outside the interior (11) of the at least one lamp vessel (1), bears against the wall of the at least one tubular lamp vessel (1) and is constructed as a supply lead, and a lamp base (4) which has at least two electric base contacts (5, 6), characterized in that the electric base contacts (5, 6) are connected in each case to an electrically conductive spring element (8, 9), each spring element (8, 9) bearing against the wall of the at least one tubular lamp vessel (1) and making an electric contact between in each case one electrode section (20, 30), arranged outside the lamp vessel (1), and a base contact (5, 6).

2. The discharge lamp as claimed in claim 1, characterized in that the spring elements (8, 9) are constructed as leaf springs which in each case have at least one expansion loop (81, 91).

3. The discharge lamp as claimed in claim 1, characterized in that the spring elements (8, 9) are constructed as leaf springs with cambered ends (80, 90), the cambered ends (80, 90) in each case making contact with the corresponding electrode section (20, 30).

4. The discharge lamp as claimed in claim 1, characterized in that there is a soldered joint between the spring elements (8, 9) and the respective electrode section (20, 30).

5. The discharge lamp as claimed in claim 1, characterized in that the electrode sections (20, 30) constructed as supply leads are fitted on the inner wall of the at least one lamp vessel (1), and the spring elements (8, 9) bear against the inner wall of the at least one lamp vessel (1).

6. The discharge lamp as claimed in claim 1, characterized in that the lamp base has at least one base shell (4) made from an electrically insulating, thermoplastic material.

7. The discharge lamp as claimed in claim 1, characterized in that the lamp base has at least one base shell (4) with a cup-like receptacle (40) for an end (13) of the at least one lamp vessel (1), the diameter of the receptacle (40) being coordinated with the outside diameter of the corresponding end (13), and the spring elements (8, 9) being arranged inside the receptacle (40) of the at least one base shell (4).

8. The discharge lamp as claimed in claim 6, characterized in that the at least one base shell (4) has a means (7) capable of being heated by radio-frequency induction and is arranged in an annular groove (42) surrounding the receptacle (40).

9. The discharge lamp as claimed in claim 7, characterized in that an electrically insulating means is arranged between the spring elements arranged in the same receptacle.

* * * * *